US007366441B2

(12) United States Patent
Hatori

(10) Patent No.: US 7,366,441 B2
(45) Date of Patent: Apr. 29, 2008

(54) METHOD AND APPARATUS FOR IMAGE FORMING HAVING A PREDETERMINED GAP FORMED BETWEEN AN IMAGE BEARING MEMBER AND A DEVELOPING MEMBER

(75) Inventor: Satoshi Hatori, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 11/207,731

(22) Filed: Aug. 22, 2005

(65) Prior Publication Data

US 2006/0039717 A1 Feb. 23, 2006

(30) Foreign Application Priority Data

Aug. 20, 2004 (JP) ..... 2004-241598

(51) Int. Cl.
*G03G 21/18* (2006.01)

(52) U.S. Cl. ..... 399/113; 399/114; 399/116; 399/119

(58) Field of Classification Search ..... 399/111, 399/113, 116, 119; 400/693
See application file for complete search history.

(56) References Cited

U.S. PATENT DOCUMENTS 5,289,234 A * 2/1994 Asano et al. ..... 399/113
5,848,329 A * 12/1998 Aoyama et al. ..... 399/113
6,856,775 B2 * 2/2005 Sekine ..... 399/109
6,934,485 B2 * 8/2005 Miyabe et al. ..... 399/113
7,162,183 B2 * 1/2007 Jeon ..... 399/113
2005/0169663 A1 * 8/2005 Shintani et al. ..... 399/111
2006/0002736 A1 * 1/2006 Kikuchi et al. ..... 399/111
2006/0045603 A1 * 3/2006 Hatori et al. ..... 400/693

FOREIGN PATENT DOCUMENTS

JP 2001-201999 7/2001

* cited by examiner

*Primary Examiner*—David M. Gray
*Assistant Examiner*—Ruth N LaBombard
(74) *Attorney, Agent, or Firm*—Oblon, Spivak, McClelland, Maier & Neustadt, P.C.

(57) ABSTRACT

A process cartridge includes an image bearing unit, a developing unit, and first and second positioning members. The image bearing unit includes a photoconductor, and a photoconductor case accommodating the photoconductor. The developing unit detachably combined with the image bearing unit includes a developer case containing a developer, a developing roller carrying the developer. The first and second positioning members are respectively disposed at each side of the photoconductor case and the developer case when the photoconductor case and the developer case are attached in combination, and is configured to position the developing roller and the photoconductor so as to regulate a gap formed between the developing roller and the photoconductor to a predetermined distance.

15 Claims, 7 Drawing Sheets

METHOD AND APPARATUS FOR IMAGE FORMING HAVING A PREDETERMINED GAP FORMED BETWEEN AN IMAGE BEARING MEMBER AND A DEVELOPING MEMBER

CROSS REFERENCE TO RELATED APPLICATIONS

The present application claims priority to Japanese patent application no. 2004-241598, filed in the Japan Patent Office on Aug. 20, 2004, the disclosure of which is incorporated by reference herein in its entirety.

BACKGROUND OF THE INVENTION

1. Field of the Invention

The present invention relates to a method and apparatus for image forming, and more particularly relates to a method and apparatus for image forming with a predetermined gap formed between an image bearing member and a developing member.

2. Description of the Related Art

A widely used process cartridge included in an image forming apparatus generally has an image bearing unit including an image bearing member and a developing unit including a developing member. The process cartridge is also detachable with respect to a main body of the image forming apparatus, for example, an electrophotographic copier, printer, facsimile machine, multifunctional machine, etc. Since the image bearing unit and the developing unit are generally separately detachable from the process cartridge, and one of the image bearing unit and the developing unit can be replaced for a shorter life cycle while the other may be continuously used, which may effectively result in a reduction in cost of replacements.

When replacing the image bearing unit and/or the developing unit, a gap formed between the image bearing member and the developing member may be out of a predetermined distance. Since a misalignment of the gap may cause deterioration in quality of a visible image formed on a surface of the image bearing member, proper alignment of the gap is necessary. That is, the gap needs to be regulated to be a constant distance or be a substantially constant distance.

In a background process cartridge, a developing unit is pivotably attached to an image bearing unit. The developing unit includes a gap regulating member and a spring. The spring applies pressure with respect to the image bearing unit to allow the gap regulating member to press contact with a surface of the image bearing member so that the gap between the image bearing unit and the developing unit can be regulated to have a predetermined distance. The image bearing member, however, can easily be worn or abraded because of the contact with the gap regulating member.

The gap regulating member held in contact with the image bearing member can wear or abrade the surface of the image bearing member and transmit vibration of the developing member to the photoconductor, which may result in deterioration of the quality of the visible image formed on the surface of the image bearing member. Further, when toner falls into a gap formed between the gap regulating member and the image bearing member, the gap formed between the developing member and the image bearing member may vary, which may be a cause of the deterioration of the quality of the visible image.

SUMMARY OF THE INVENTION

The present invention has been made in view of the above-described circumstances.

An object of the present invention is to provide a novel process cartridge in which a predetermined gap is formed between an image bearing member and a developing member.

Another object of the present invention is to provide a novel method of positioning a process cartridge for image forming.

Another object of the present invention is to provide a novel image forming apparatus including the above-described novel process cartridge.

In one embodiment, a novel process cartridge detachably attached to an image forming apparatus includes an image bearing unit, a developing unit, and first and second positioning members. The image bearing unit is detachably disposed in the process cartridge and includes a photoconductor configured to form an image on a surface thereof, and a photoconductor case configured to accommodate the photoconductor. The developing unit is detachably disposed in the process cartridge and detachably combined with the image bearing unit, and includes a developer case configured to contain a developer, and a developing roller configured to carry the developer on a surface thereof to develop a toner image based on the image formed on the surface of the photoconductor. The first and second positioning members are respectively disposed at each side of the photoconductor case and the developer case when the photoconductor case and the developer case are attached in combination, and are configured to position the developing roller and the photoconductor so as to regulate a gap formed between the developing roller and the photoconductor to a predetermined distance.

Further, in one embodiment, a novel method of regulating a gap formed between a photoconductor and a developing roller to a predetermined distance includes combining an image bearing unit including the photoconductor to a developing unit including the developing roller, positioning the image bearing unit and the developing unit with first and second positioning members fixed to respective sides of the image bearing unit and the developing unit, mounting a process cartridge including the image bearing unit and the developing unit to an image forming apparatus, and inserting a photoconductor supporting shaft into the image bearing unit.

Further, in one embodiment, a novel image forming apparatus includes an optical writing unit and a process cartridge. The optical writing unit is configured to emit a laser light beam to write an image. The process cartridge includes an image bearing unit, a developing unit, and first and second positioning members. The image bearing unit is detachably disposed in the process cartridge, and includes a photoconductor configured to form the image emitted by the optical writing unit on a surface thereof, and a photoconductor case configured to accommodate the photoconductor. The developing unit is detachably disposed in the process cartridge and detachably combined with the image bearing unit, and includes a developer case configured to contain a developer, and a developing roller configured to carry the developer on a surface thereof to develop a toner image based on the image formed on the surface of the photoconductor. The first and second positioning members are respectively disposed at each side of the photoconductor case and the developer case when the photoconductor case and the developer case are attached in combination, and are configured to position the developing roller and the photoconductor so as to regulate a gap formed between the developing roller and the photoconductor to a predetermined distance.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
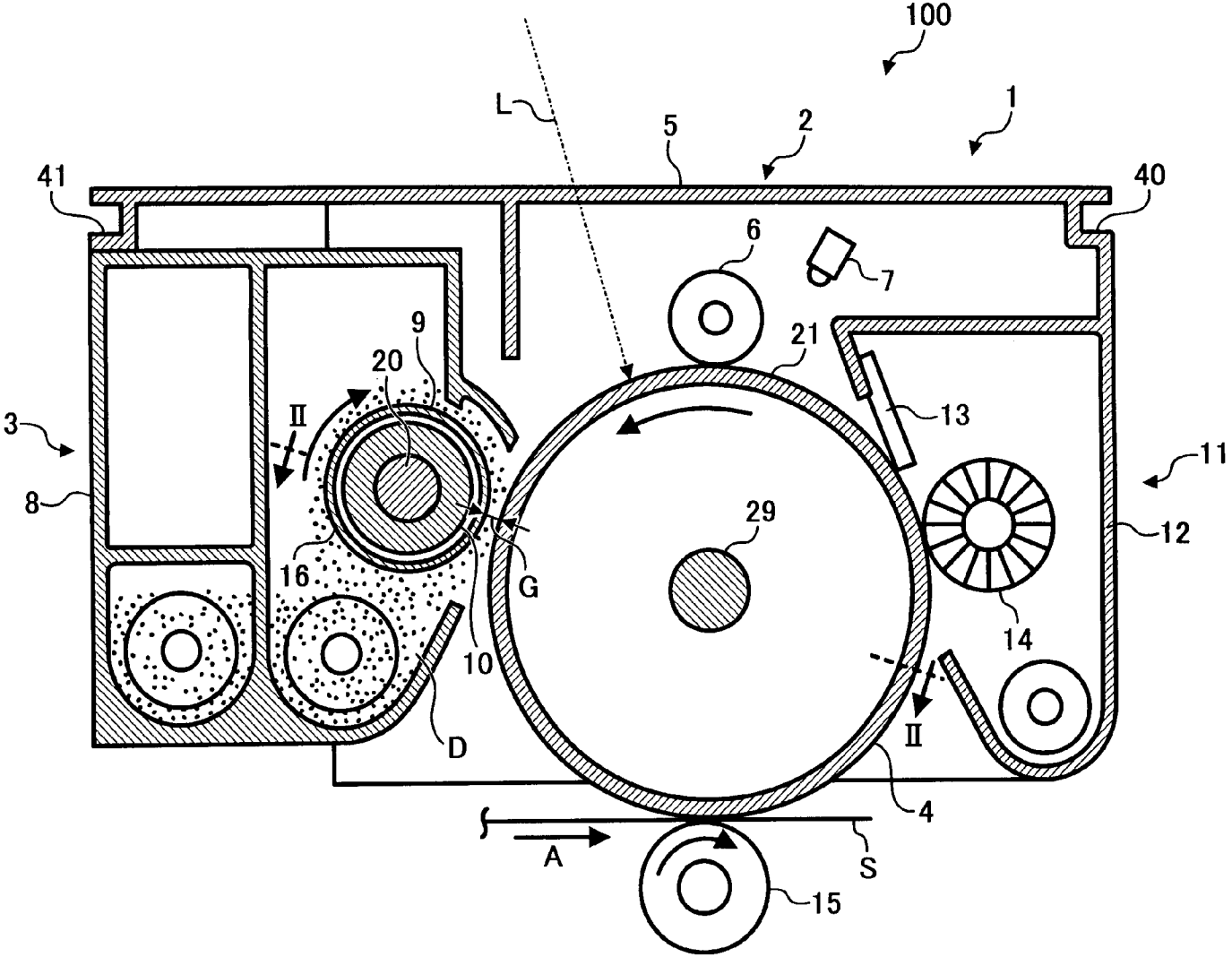
FIG. 1 is a schematic structure of a process cartridge included in an image forming apparatus, according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
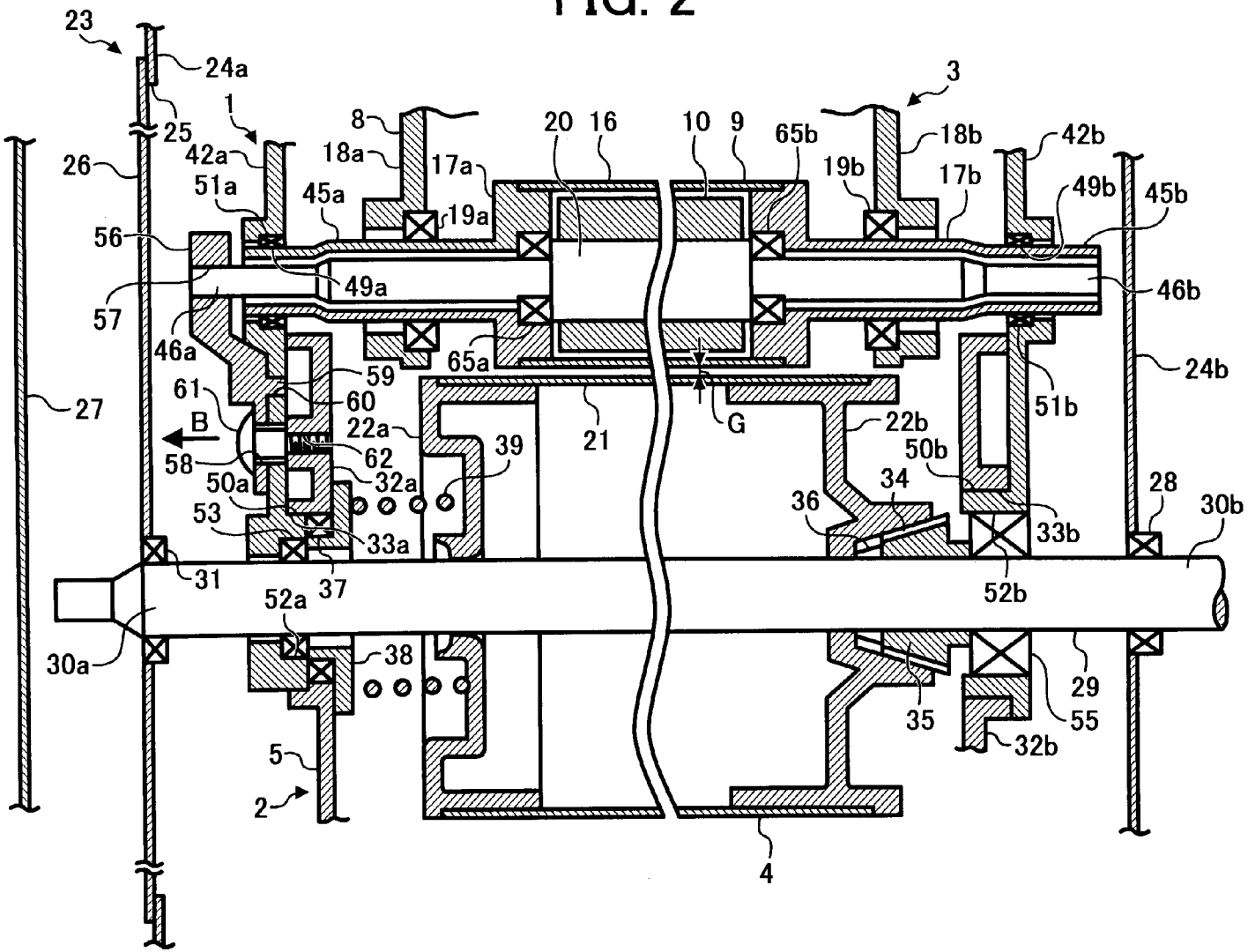
FIG. 2 is a cross sectional view of the process cartridge when mounted to the image forming apparatus.

Referring to FIGS. 1 and 2, a process cartridge 1 mounted to a predetermined position inside an image forming apparatus 100 is described according to an exemplary embodiment of the present invention.

FIG. 1 shows a schematic structure of the process cartridge 1, and FIG. 2 shows a detailed structure thereof, along the line II-II of FIG. 1.

The process cartridge 1 includes a photoconductor unit 2 and a developing unit 3.

The photoconductor unit 2 includes a photoconductor 4 and a photoconductor case 5.

The photoconductor 4 includes a photoconductor body 21 to which a laser light beam from an optical writing unit (not shown) is emitted to form an image. When the process cartridge 1 is mounted to the image forming apparatus 100, the photoconductor 4 is supported by a photoconductor supporting shaft 29 provided in the image forming apparatus 100, which will be described later.

The photoconductor case 5 accommodates the photoconductor 4 therein as well as a charging roller 6 and a discharging lamp 7. The photoconductor case 5 further includes guide grooves 40 and 41. The guide grooves 40 and 41 are respectively arranged at the upper portions of opposite sides of the photoconductor case 5, running in a direction parallel to an axial direction of the photoconductor 4 for a smooth and proper movement of the process cartridge 1 in the image forming apparatus 100.

The developing unit 3 includes a developer case 8 and a developing roller 9 having front and rear ends 45*a* and 45*b* in an axial direction.

The developer case 8 contains dry-type developer D.

The developing roller 9 carries the developer D on a surface of the developing roller body 16 to convey the developer D to the photoconductor 4. The developing roller 9 includes a magnet 10, a developing roller body 16, and a developing roller shaft 20 having front and rear ends 46*a* and 46*b*.

The magnet 10 has a cylindrical shape and is fixedly supported by the developing roller shaft 20. The magnet 10 is polarized with a plurality of magnetic poles in a circumferential direction thereof.

The developing unit 3 has a two-component developer D containing toner and carrier, but the present invention is not limited only to such developer. For example, an embodiment of the present invention can use a one-components developer containing toner without carrier. Both the one-component and two-component developers may include magnetic materials.

The photoconductor unit 2 and the developing unit 3 are detachably attached to each other, and have a gap G with a predetermined distance therebetween. Details as to how to attach the photoconductor unit 2 and the developing unit 3 are attached are described later.

The photoconductor unit 2 further includes a cleaning unit 11 integrally attached thereto. The cleaning unit 11 includes a cleaning case 12, a cleaning blade 13, and a cleaning brush 14. The cleaning case 12 is formed of a portion of the photoconductor case 5. The cleaning blade 13 is fixedly supported by the cleaning case 12 and is held in contact with the surface of the photoconductor 4. The cleaning brush 14 is rotatably supported by the cleaning case 12 and is held in contact with the surface of the photoconductor 4.

Although the cleaning unit 11 is formed as a portion of the photoconductor unit 2 in the present invention, the cleaning unit 11 and the photoconductor unit 2 may be formed as different units which can be detachably attached to each other.

An image forming operation of the process cartridge 1 of the image forming apparatus 100 is now described.

When the image forming operation is started, the photoconductor 4 is rotated in a counterclockwise direction in FIG. 1. The charging roller 6 is rotated as the photoconductor 4 starts its rotation, and is applied with a bias so that the surface of the photoconductor 4 may uniformly be charged to a predetermined polarity. The optical writing unit (not shown) disposed in the image forming apparatus 100 emits a laser light beam L. The laser light beam L irradiates the surface of the photoconductor 4 to form an image, for example an electrostatic latent image, on the surface of the photoconductor 4.

The developing roller 9 carries the developer D attracted to the surface thereof by magnetic force generated by the magnet 10.

When the developing roller 9 is rotated in a clockwise direction in FIG. 1, the developer D on the surface of the developing roller 9 is conveyed to the same direction as the rotation direction of the developing roller 9. Toner included in the developer D is electrically transferred to the electrostatic latent image formed on the surface of the photoconductor 4. Thus, the electrostatic latent image is visualized to a toner image.

With the above-described image forming operation, the process cartridge 1 of the present invention may produce a visible toner image on the surface of the photoconductor 4 with the developer D carried by the developing roller 9.

The image forming apparatus 100 further includes a transfer roller 15. The transfer roller 15 is rotatably supported by a main body of the image forming apparatus 100 and is rotated in a clockwise direction in FIG. 1. A transfer sheet S which is a recording medium fed from a sheet feeding mechanism (not shown) provided in the image forming apparatus 100 travels between the transfer roller 15 and the photoconductor 4 in a direction indicated by arrow A in FIG. 1. At this time, the transfer roller 15 is applied with a transfer bias so that the toner image formed on the surface of the photoconductor 4 may be transferred onto the transfer sheet S. The transfer sheet S is conveyed to a fixing unit (not shown). The fixing unit fixes the toner image formed on the transfer sheet S by applying heat and pressure. The transfer sheet S having the fixed toner image is discharged to a sheet discharging tray (not shown) of the image forming apparatus 100.

Even after the toner image formed on the photoconductor 4 is transferred onto the transfer sheet S, some toner still remains on the surface of the photoconductor 4 without being transferred onto the transfer sheet S. The cleaning blade 13 and the cleaning brush 14 of the cleaning unit 11 remove such residual toner from the surface of the photoconductor 4. After the residual toner is removed from the surface of the photoconductor 4, the discharging lamp 7 irradiates discharging light to the surface of the photoconductor 4 to initialize a surface potential of the photoconductor 4.

As previously described, the developing roller 9 includes the developing roller body 16 that carries the developer D on the surface thereof. As shown in FIG. 2, the developing roller body 16 has a cylindrical shape. The developing roller 9 further includes first and second developing roller members 17*a* and 17*b*.

The first and second developing roller members 17*a* and 17*b* are in a form of a cylindrical shape, and are respectively fixed by pressure to each end of the developing roller body 16 in the axial direction of the developing roller body 16. The first and second developing roller members 17*a* and 17*b* are attached to side walls 18*a* and 18*b* of the developer case 8 via bearings 19*a* and 19*b*, respectively.

Figure 3:
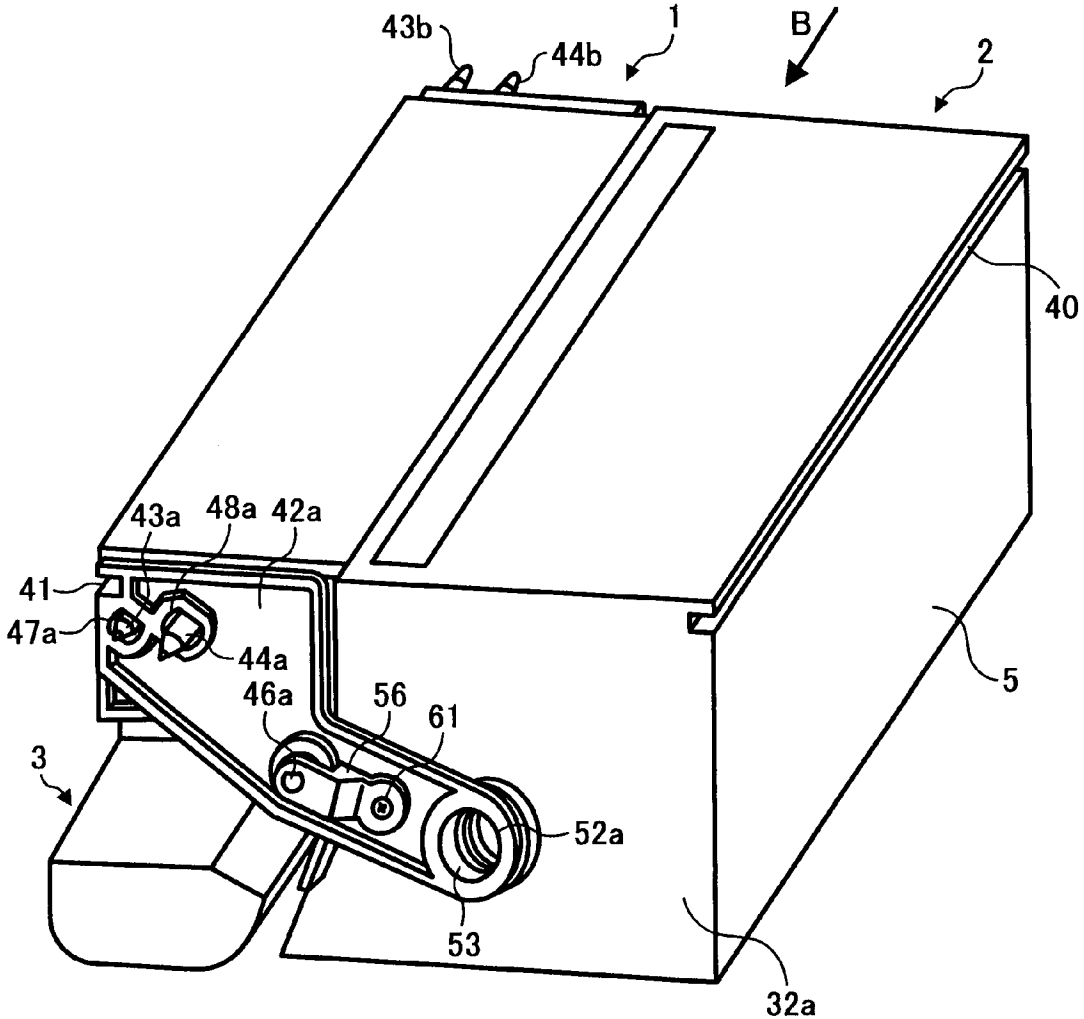
FIG. 3 is a perspective view of the process cartridge of FIG. 1 when removed from the image forming apparatus.

The side walls 18*a* and 18*b* have first and second positioning pins 43*a* and 43*b*, respectively (see FIG. 3). The first and second positioning pins 43*a* and 43*b* are concentrically provided to each other in a protruding condition.

Further, the first end 45*a* of the developing roller 9 and the first end 46*a* of the developing roller shaft 20 are extended from the side wall 18*a* of the developer case 8. The second end 45*b* of the developing roller 9 and the second end 46*b* of the developing roller shaft 20 are extended from the side wall 18*b* of the developer case 8.

The developing roller shaft 20 fixedly supporting the magnet 10 is concentrically disposed through the first and second developing roller members 17*a* and 17*b*. The developing roller 9 is rotatably attached to the developing roller shaft 20 via bearings 65*a* and 65*b*.

Further, as previously described, the photoconductor 4 includes the photoconductor body 21 that forms an electrostatic latent image on the surface thereof so as to form a toner image based on the electrostatic latent image. In FIG. 2, the photoconductor body 21 is shown as a form of a cylindrical shape.

The photoconductor 4 further includes first and second photoconductor flanges 22*a* and 22*b*. The first and second photoconductor flanges 22*a* and 22*b* are in a form of a cylindrical shape, have respective center holes, and are respectively fixed at each end of the photoconductor body 21 in the axial direction.

The image forming apparatus 100 has a main body 23 which includes a front plate 24*a*, a rear plate 24*b*, an opening 25, a front cover plate 26, a front door 27, and the process cartridge 1.

The front plate 24*a* is disposed at a front side (or a left side in FIG. 2) of the main frame 23 of the image forming apparatus 100. The rear plate 24*b* is disposed at a rear side (or a right side in FIG. 2) of the main frame 23 of the image forming apparatus 100. The opening 25 is formed on the front plate 24*a* and is covered by the front cover plate 26. The front cover plate 26 is detachably fixed by a screw (not shown) and is positioned at a predetermined location with respect to the front plate 24*a*. The front door 27 is placed before the front cover plate 26. That is, the front door 27 is disposed at a further front side (or a further left side in FIG. 2) of the main frame 23 of the image forming apparatus 100. Since the front door 27 is pivotably disposed at the main body 23, the front door 27 can move between an open position and a closed position with respect to the main frame 23 of the image forming apparatus 100. A supporting plate (not shown) is disposed at a further rear side (or a further right side in FIG. 2) of the main frame 23 of the image forming apparatus 100.

As previously described, the image forming apparatus 100 includes the photoconductor supporting shaft 29. The photoconductor supporting shaft 29 is a shaft for supporting the photoconductor 4 when the process cartridge 1 is mounted to the image forming apparatus 100. Conversely, the photoconductor supporting shaft 29 can be detached from the photoconductor 4 when the process cartridge 1 is removed from the image forming apparatus 100. The photoconductor shaft 29 includes a front end 30*a* and a rear end 30*b*. The front end 30*a* of the photoconductor supporting shaft 29 is rotatably supported by the front cover plate 26 via a bearing 31. The rear end 30*b* of the photoconductor supporting shaft 29 is rotatably supported by the rear plate 24*b* and the supporting plate of the image forming apparatus 100 via a bearing 28.

In FIG. 2, the photoconductor case 5 includes side walls 32*a* and 32*b*. The side walls 32*a* and 32*b* include first and second shaft holes 33*a* and 33*b*, respectively. The side walls 32*a* and 32*b* further includes first and second reference pins 44*a* and 44*b*, respectively (see FIG. 3). The first and second reference pins 44*a* and 44*b* are concentrically provided in a protruding manner.

When the process cartridge 1 is mounted to a predetermined position provided inside the image forming apparatus 100, the photoconductor supporting shaft 29 goes through axial ends of the photoconductor 4 and the first and second shaft holes 33*a* and 33*b* formed on the respective side walls 32*a* and 32*b* of the photoconductor case 5. The photoconductor supporting shaft 29 of FIG. 2 further goes through the respective center holes formed on the photoconductor flanges 22*a* and 22*b*. Accordingly, the photoconductor supporting shaft 29 does not directly contact the photoconductor case 5.

The photoconductor supporting shaft 29 further includes an engaging member 35. The engaging member 35 is in a form of a tapered bore in which a cross sectional area thereof becomes greater as the cross sectional area becomes closer to the rear end 30*b* of the photoconductor supporting shaft 29. The engaging member 35 is integrally mounted around an outer circumference of the photoconductor supporting shaft 29, at a portion in close to or in the vicinity of the rear end 30*b* of the photoconductor supporting shaft 29. The engaging member 35 has an outer circumference formed with a plurality of teeth 34 which are configured to be engaged with a plurality of teeth 36 formed on an inner circumference of the center hole of the second photoconductor flange 22*b*. Further, the side wall 32*a* of the photoconductor case 5 rotatably engages with a spring member bearing 38 via a bearing 37. A compression spring 39 is disposed between the spring member bearing 38 and the first photoconductor flange 22*a* so that the plurality of teeth 34 formed on the engaging member 35 may fixedly mesh with the plurality of teeth 36 formed on the second photoconductor flange 22*b*, thereby preventing a relative rotation between the photoconductor 4 and the photoconductor supporting shaft 29.

When a motor (not shown) drives the photoconductor supporting shaft 29 to rotate the same, the force of rotation of the photoconductor supporting shaft 29 may be transmitted to the photoconductor 4 via the engaging member 35. The photoconductor 4 is then rotated to perform the above-described image forming operation. At this time, a driving unit (not shown) drives the developing roller 9 so as to rotate. Further, as shown in FIG. 2, the photoconductor supporting shaft 29 has a bearing 55 arranged at a portion closer to the rear end 30*b* thereof than the engaging member 35 for properly positioning the photoconductor unit 2 and the developing unit 3 to form the gap G therebetween.

To form the gap G having a predetermined distance between the photoconductor 4 and the developing roller 9, the process cartridge 1 of the present invention provides first and second positioning members 42*a* and 42*b* and a magnet positioning member 56 to properly position the photoconductor unit 2 and the developing unit 3.

The first and second positioning members 42*a* and 42*b* include first and second developing roller positioning holes 49*a* and 49*b*, first and second photoconductor positioning holes 50*a* and 50*b*, bearings 51*a* and 51*b*, holes 52*a* and 52*b*, and a bearing 53. Details of the structures and functioning of the first and second positioning members 42*a* and 42*b* will be described later.

The magnet positioning member 56 includes an engaging hole 57, a mounting hole 58, a positioning pin 59, a positioning hole 60, and a screw hole 62 for a screw 61. Details of the structure and function of the magnet positioning member 56 will be described later.

The process cartridge 1 can be removed from the image forming apparatus 1 by pulling out the process cartridge 1 from the main body 23 in a direction indicated by arrow B in FIG. 2. Conversely, the process cartridge 1 can be mounted to the image forming apparatus 1 by inserting the process cartridge 1 into the main body 23 in a direction opposite to the direction B.

Figure 7:
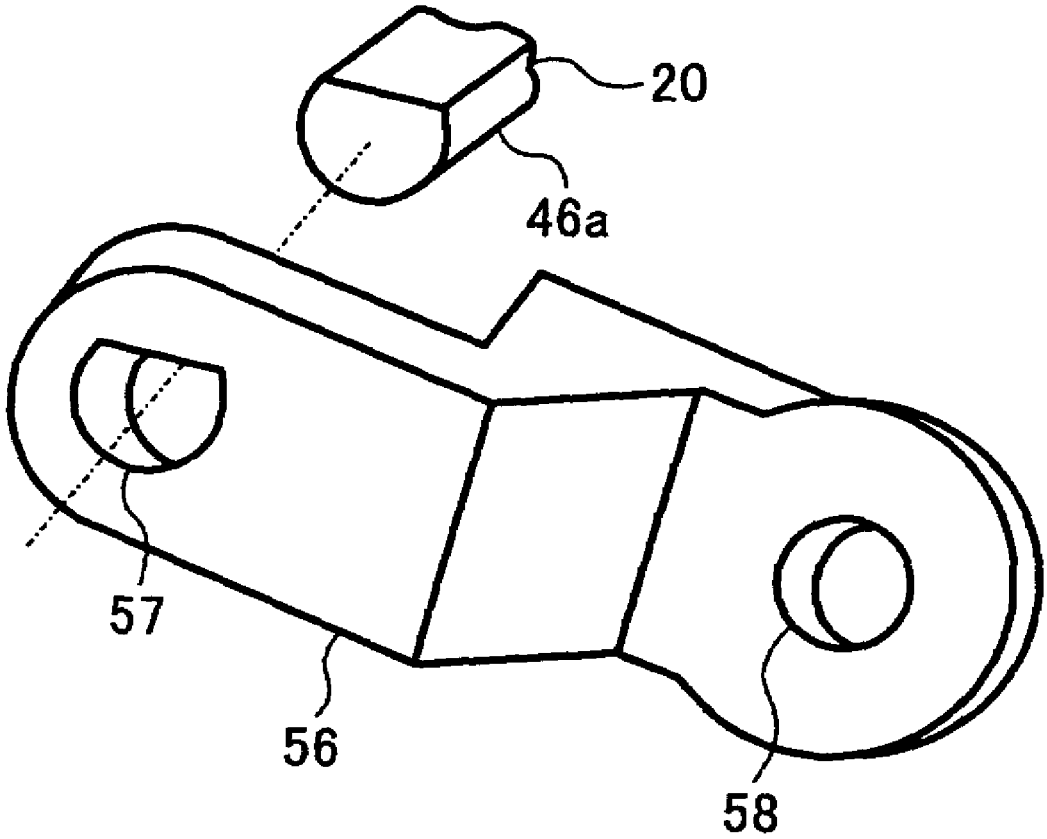
FIG. 7 is a perspective view of a magnet positioning member.

Referring to FIGS. 3 and 7, the structures and functions of the process cartridge 1 when the process cartridge 1 is removed from the image forming apparatus 100 are described.

Figure 4:
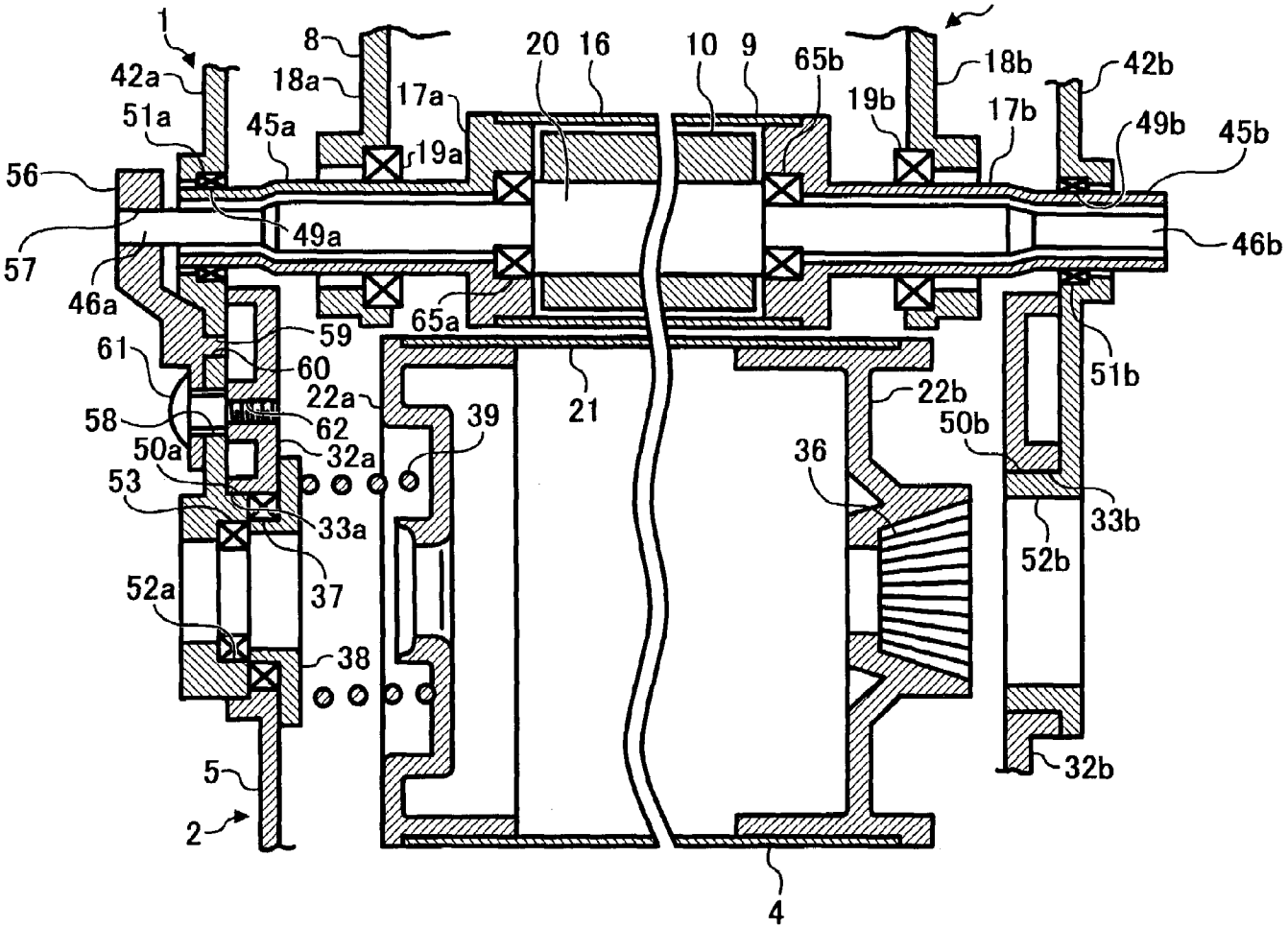
FIG. 4 is a cross sectional view of the process cartridge when removed from the image forming apparatus.

FIG. 3 shows the process cartridge 1 removed from the main body 23 of the image forming apparatus 100, and FIG. 4 shows a cross sectional view of the process cartridge 1 of FIG. 3, viewed from the same angle as the structure illustrated in FIG. 2.

As previously described, the process cartridge 1 can be removed from the image forming apparatus 100 by pulling out of the main body 23 in the direction B as shown in FIGS. 2 and 3. Firstly, a user opens the front door 27 of the image forming apparatus 100, and detaches the front cover plate 26 from the front plate 24*a*. The user then pulls the process cartridge 1 from the main body 23 toward the user in the direction B. Thus, the user can remove the process cartridge 1 out of the image forming apparatus 100.

Conversely, the process cartridge 1 can be inserted into the main body 23 of the image forming apparatus 100 by performing the above-described operations in an opposite manner.

For a smooth and proper mounting of the process cartridge 1 to the image forming apparatus 100, the guide grooves 40 and 41 formed on the photoconductor case 5 allow the process cartridge 1 to smoothly move in the image forming apparatus 100. The guide grooves 40 and 41 are slidably engaged with respective guide rails (not shown) arranged at the main body 23 of the image forming apparatus 100. When the process cartridge 1 is removed from the main body 23 of the image forming apparatus 100, the user pulls the process cartridge 1 toward the user, which is in the direction B. The process cartridge 1 may slide along the guide grooves 40 and 41 and smoothly be removed from the image forming apparatus 100. Conversely, when the process cartridge 1 is inserted into the main body 23 of the image forming apparatus 100, the user pushes the process cartridge 1 in a direction opposite to the direction B. The process cartridge 1 may slide along the guide grooves 40 and 41 and smoothly be inserted into the main body 23 of the image forming apparatus 100.

As shown in FIGS. 3 and 4, when the process cartridge 1 is removed from the main body 23 of the image forming apparatus 100, the photoconductor supporting shaft 29 mounted to the image forming apparatus 100 in a cantilevered manner is detached from the photoconductor 4 and the photoconductor case 5. After the photoconductor supporting shaft 29 is detached, the photoconductor 4 may be held in the photoconductor case 5.

The photoconductor unit 2 and the developing unit 3 are detachably mounted to the process cartridge 1. As previously described, the gap G is formed to have a predetermined distance between the photoconductor 4 of the photoconductor unit 2 and the developing roller 9 of the developing unit 3 when the photoconductor unit 2 and the developing unit 3 are mounted to the process cartridge 1.

It is desirable for the gap G to be regulated to have the predetermined distance. When a distance of the gap G is greater than the predetermined distance, a toner image formed on the surface of the photoconductor 4 may deteriorate in image quality. Conversely, when the distance of the gap G is smaller than the predetermined distance, the toner image on the surface of the photoconductor 4 may also have deterioration in image quality. Therefore, the first and second positioning members 42*a* and 42*b* are attached to the process cartridge 1 to form the gap G having the predetermined distance between the photoconductor 4 and the developing roller 9.

When the photoconductor unit 2 and the developing unit 3 are combined, the first and second positioning members 42*a* and 42*b* are used for properly positioning the photoconductor unit 2 and the developing unit 3.

Both the first and second positioning members 42*a* and 42*b* respectively have a plurality of different types of holes.

The first positioning member 42*a* has long holes including a first positioning hole 47*a* and a first reference hole 48*a*. The second positioning member 42*b* has long holes including a second positioning hole 47*b* and a second reference hole 48*b*.

Holes provided with the bearings 51*a* and 51*b* are also formed on the first and second positioning members 42*a* and 42*b*, respectively. The bearing 51 a on the first positioning member 42*a* forms the first developing roller positioning hole 49*a* along an inner circumference thereof, and the bearing 51*b* on the second positioning member 42*b* forms the second developing roller positioning hole 49*b* along an inner circumference thereof.

Further, the first positioning member 42*a* includes the hole 52*a* provided with the bearing 53, and the photoconductor positioning part 50*a* (see FIGS. 2 and 4) having a ring shape concentric with respect to the bearing 53. The second positioning member 42*b* includes the hole 52*b*, and the photoconductor positioning part 50*b* having a ring shape concentric with respect to the hole 52*b*.

Figure 5:
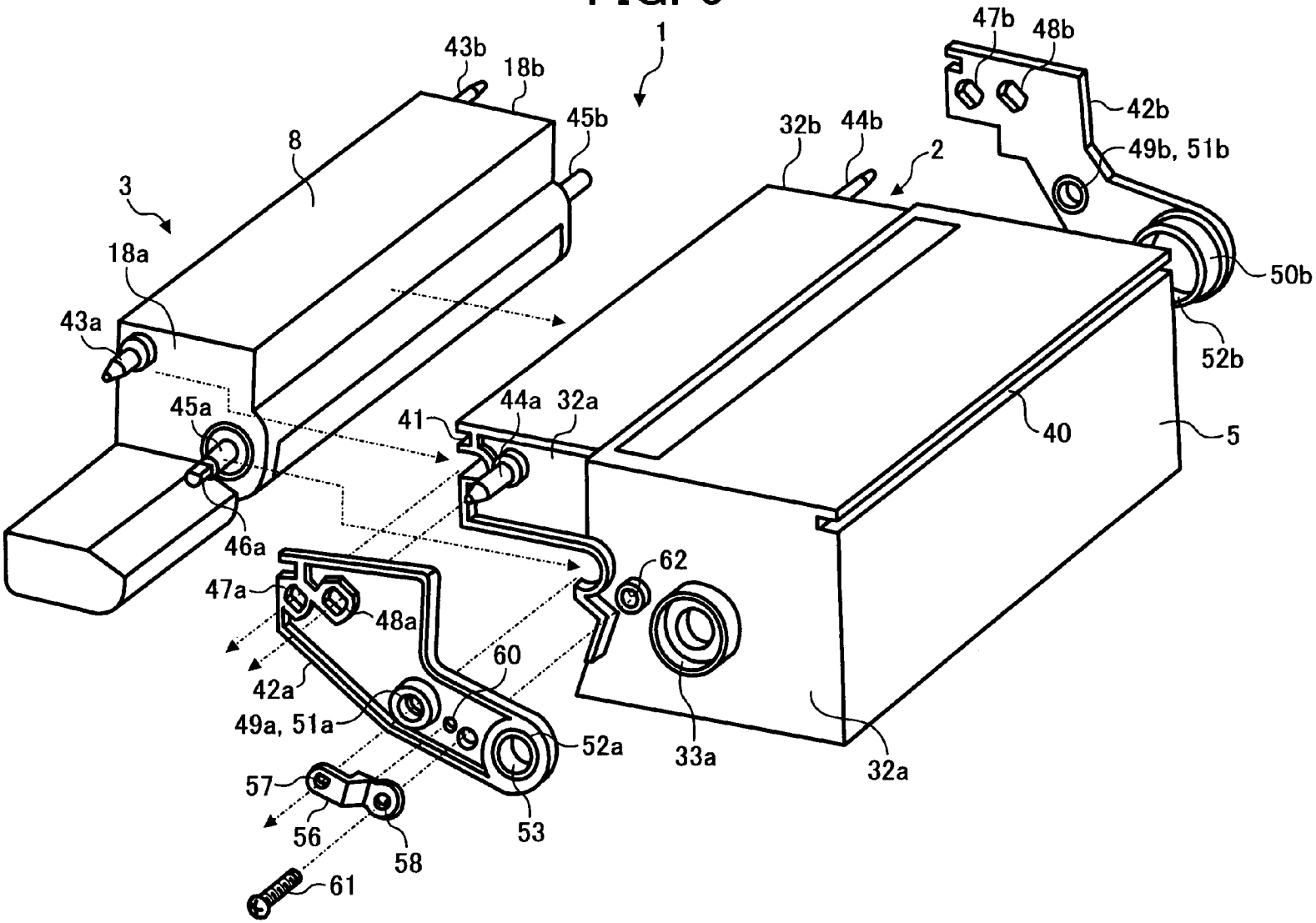
FIG. 5 is a perspective view of a developing unit before being mounted to the process cartridge.
Figure 6:
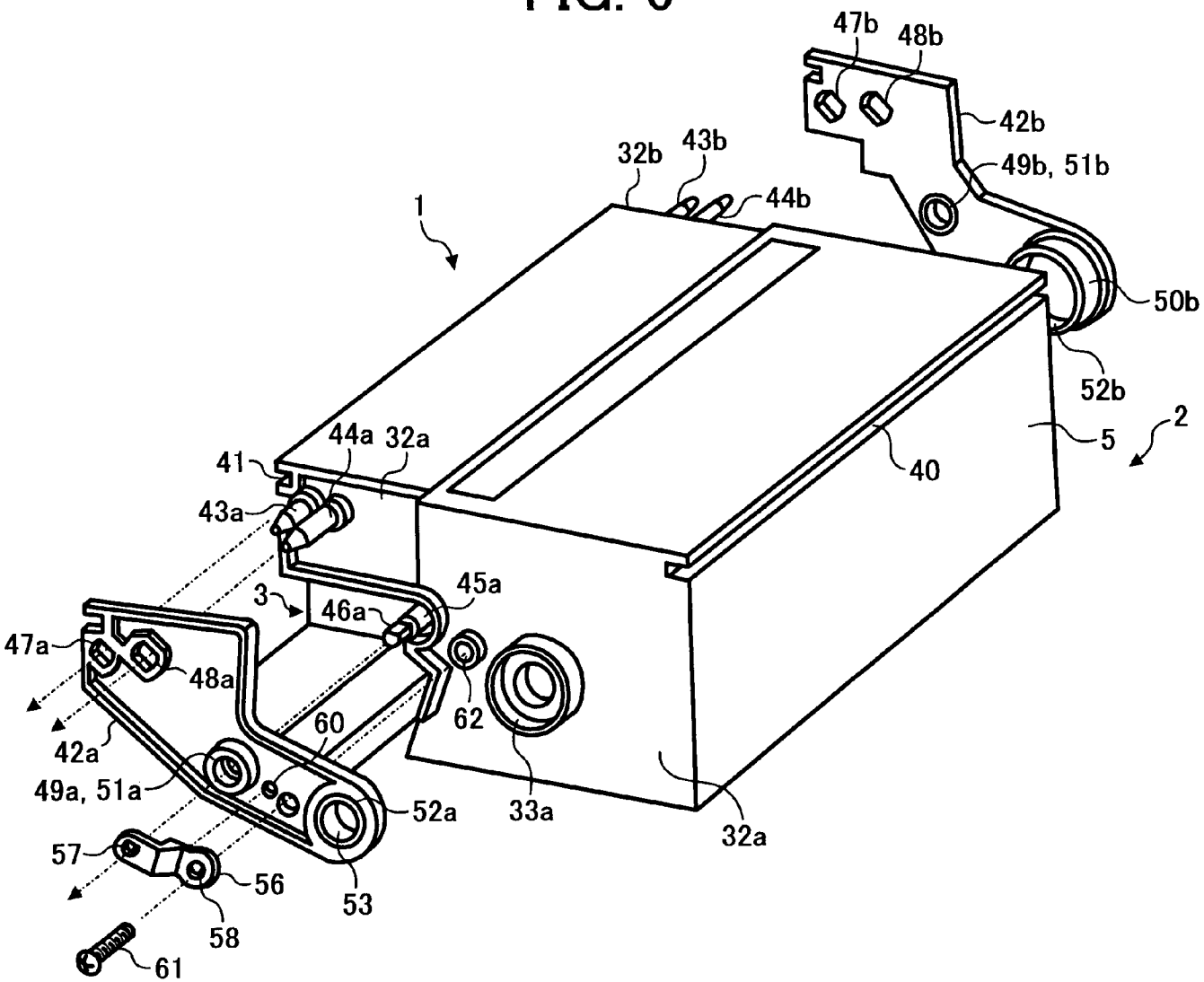
FIG. 6 is a perspective view of the developing unit after being mounted to the process cartridge.

Now, mounting operations of the photoconductor unit 2 and the developing unit 3 with the first and second positioning members 42*a* and 42*b* are described, referring to FIGS. 5 and 6.

First, the developing unit 3 is fitted into the photoconductor unit 2 as shown in FIG. 5.

Next, the first positioning member 42*a* is fitted to one side of a combined form of the photoconductor unit 2 and the developing unit 3. More specifically, the first positioning pin 43*a* of the developing unit 3 goes through the first positioning hole 47*a*, the first reference pin 44*a* of the photoconductor unit 2 goes through the first reference hole 48*a*, and the first end 45*a* of the developing roller 9 goes through the first developing roller positioning hole 49*a* of the bearing 51 a disposed at the first positioning member 42*a*.

Further, the first photoconductor positioning part 50*a* goes through the first shaft hole 33*a* formed on the side wall 32*a* of the photoconductor case 5.

The second positioning member 42*b* is then fitted to the other side of the combined form of the photoconductor unit 2 and the developing unit 3. More specifically, the second positioning pin 43*b* of the developing unit 3 goes through the second positioning hole 47*b*, the second reference pin 44*b* of the photoconductor unit 2 goes through the second reference hole 48*b*, and the second end 45*b* of the developing roller 9 goes through the second developing roller positioning hole 49*b* of the bearing 51*b* disposed at the second positioning member 42*b*. The second photoconductor positioning part 50*b* goes through the second shaft hole 33*b* formed on the side wall 32*b* of the photoconductor case 5.

After the first and second positioning members 42*a* and 42*b* are fixed with screws (not shown), the photoconductor unit 2 and the developing unit 3 are positioned with the first and second positioning members 42*a* and 42*b* to the side walls 32*a* and 32*b* of the photoconductor case 5.

The process cartridge 1 with the photoconductor unit 2 and the developing unit 3 mounted thereto can be inserted into the main body 23 of the image forming apparatus 100 by pushing in the direction opposite to the direction B of FIG. 2. When the process cartridge 1 is inserted into the main body 23 of the image forming apparatus 100, the photoconductor supporting shaft 29 having the rear end 30*b* fixed in a cantilevered way to the main body 23 of the image forming apparatus 100 goes through the first and second positioning members 42*a* and 42*b*, the photoconductor case 5, and the photoconductor 4. More specifically, the hole 52*b* on the second positioning member 42*b* is engaged with the outer circumference of the bearing 55 attached to the photoconductor supporting shaft 29. The respective center holes of the first and second photoconductor flanges 22*a* and 22*b* of the photoconductor 4 are fitted into the photoconductor supporting shaft 29. Thus, the photoconductor 4 may be supported by the photoconductor supporting shaft 29. When the photoconductor supporting shaft 29 goes through the photoconductor 4, the compression spring 39 allows the plurality of teeth 36 formed on the second photoconductor flange 22*b* to firmly be engaged with the plurality of teeth 34 formed on the engaging member 35. Thereby, the bearing 53 provided to the first positioning member 42*a* may be fitted to the photoconductor supporting shaft 29.

As described above, the first and second positioning members 42*a* and 42*b* are used for the smooth and proper positioning of the process cartridge 1. Namely, the first end 45*a* of the developing roller 9 is fitted to the first developing roller positioning hole 49*a* of the first positioning member 42*a*. The second end 45*b* of the developing roller 9 is fitted to the second developing roller positioning hole 49*b* of the second positioning member 42*b*. By performing the above-described two mounting operations, the developing roller 9 may be positioned with respect to the first and second positioning members 42*a* and 42*b*.

Then, the first photoconductor positioning part 50*a* of the first positioning member 42*a* is fitted to the first shaft hole 33*a* and the second photoconductor positioning part 50*b* of the second positioning member 42*b* is fitted to the second shaft hole 33*b*. By performing the above-described operation, the first and second positioning members 42*a* and 42*b* may respectively be positioned with respect to the combined form of the photoconductor case 5 and the photoconductor 4 via the photoconductor supporting shaft 29. Thereby, the photoconductor 4 may be positioned with respect to the first and second positioning members 42*a* and 42*b*.

When both the photoconductor 4 and the developing roller 9 are properly positioned to each other, the gap G formed between the photoconductor 4 and the developing roller 9 may be kept to a predetermined distance. More specifically, the gap G is preferably set to a distance between approximately 0.2 mm and approximately 0.4 mm.

Further, as previously described, the first and second positioning pins 43*a* and 43*b* are fitted into the first and second positioning holes 47*a* and 47*b*, respectively, and the first and second reference pins 44*a* and 44*b* are fitted into the first and second reference holes 48*a* and 48*b*. These fitting operations may prevent rotations of the photoconductor unit 2 and the developing unit 3. That is, the fitting operations described above may prevent the photoconductor unit 2 from rotating around the photoconductor supporting shaft 29 and the developing unit 3 from rotating around the developing roller 9, so that the photoconductor 4 and the developing roller 9 may be properly positioned.

As described above, the process cartridge 1 of the present invention is provided with the first and second positioning members 42*a* and 42*b* attached on both sides of the photoconductor case 5 and the developer case 8 for positioning the photoconductor 4 and the developing roller 9, so that the gap G formed between the photoconductor 4 and the developing roller 9 may be set to the predetermined distance. More specifically, the first positioning member 42*a* includes the first developing roller positioning hole 49*a* for fitting to the first end 45*a* of the developing roller 9 extending from the developer case 8 and the first photoconductor positioning part 50*a* for fitting into the first shaft hole 33*a*. The second positioning member 42*b* includes the second developing roller positioning hole 49*b* for fitting to the second end 45*b* of the developing roller 9 extending from the developer case 8 and the second photoconductor positioning part 50*b* for fitting into the second shaft hole 33*b*. Therefore, when the process cartridge 1 is inserted into the main body 23 of the image forming apparatus 100 by allowing the photoconductor supporting shaft 29 to go through the photoconductor 4 and the first and second shaft holes 33*a* and 33*b* of the photoconductor case 5, the photoconductor 4 and the developing roller 9 may be positioned to regulate the gap G formed therebetween to the predetermined distance.

With the above-described structure, the gap regulating member disposed at the developing roller 9 may avoid contacting the surface of the photoconductor 4, thereby providing a desirable predetermined distance between the photoconductor 4 and the developing roller 9. The structure of the process cartridge 1 may also prevent wear or abrasions of the photoconductor 4, provide a longer life thereof, and avoid vibrations of the photoconductor 4 and variations of distant of the gap G. This may result in producing a visible toner image in high quality.

In a case where a distance of the gap G formed between the developing roller 9 and the photoconductor 4 is regulated by positioning the photoconductor unit 2 with the developing unit 3, the distance may vary due to errors occurred during a positioning of the photoconductor unit 2 and the developing unit 3.

The process cartridge 1 of the present invention uses the first and second positioning members 42*a* and 42*b* to position the developing roller shaft 20 and the photoconductor supporting shaft 29 so that the gap G formed between the developing roller 9 and the photoconductor 4 may be firstly regulated. At this time, the photoconductor unit 2 can automatically be positioned with respect to the developing unit 3.

As described above, the process cartridge 1 of the present invention regulates the distance of the gap G formed between the developing roller 9 and the photoconductor 4 prior to the positioning of the photoconductor unit 2 and the developing unit 3. This prevents the errors in positioning the photoconductor unit 2 and the developing unit 3, thereby preventing errors in the distance of the gap G between the photoconductor 4 and the developing roller 9.

As previously described, the developing unit 3 of the process cartridge 1 of the present invention includes the magnet 10 disposed inside the developing roller 9 and the developing roller shaft 20 which fixedly supports the magnet 10 and rotatably supports the developing roller 9. The magnet 10 and the developing roller shaft 20 are fixed to the process cartridge 1 and are prevented from rotations.

As previously described, the magnet 10 is polarized with a plurality of magnetic poles in the circumferential direction thereof. One of the plurality of magnetic poles is a main pole of the magnet 10, and is preferable to be fixedly and properly disposed at a predetermined position to substantially face the photoconductor 4 because a misalignment of the main pole of the magnet 10 in the circumferential direction may cause deterioration in image quality of the visible toner image formed on the photoconductor 4.

FIG. 7 shows the magnet positioning member 56 for a proper alignment of the magnet 10.

The process cartridge 1 of the present invention uses the magnet positioning member 56 to properly fix the position of the magnet 10.

As previously shown in FIGS. 2 to 7, the magnet positioning member 56 includes the engaging hole 57, the mounting hole 58, and the positioning pin 59. The engaging hole 57 is a D-shaped hole to be engaged with the first end 46*a* of the developing roller shaft 20 having a D-shaped cross section. As shown in FIGS. 2 to 6, the first positioning member 42*a* may be attached to one side of the photoconductor unit 2 and the developing unit 3. After the attachment of the first positioning member 42*a* to the photoconductor unit 2 and the developing unit 3, the first end 46*a* of the developing roller shaft 20 is fitted into the engaging hole 57 of the magnet positioning member 56 while the positioning pin 59 of the magnet positioning member 56 is fitted into the positioning hole 60 formed on the first positioning member 42*a*.

Through the above-described fitting operations, the magnet positioning member 56 may be positioned with respect to the first positioning member 42*a*. Since the first end 46*a* of the developing roller shaft 20 having the D-shaped cross section is fitted into the engaging hole 57 having the D-shaped hole, the developing roller shaft 20 and the magnet 10 integrally mounted on the developing roller shaft 20 may be fixed in a predetermined circumferential position, thereby properly positioning the circumferential position of the main pole of the magnet 10. After the circumferential position of the main pole of the magnet 10 is fixed, the screw 61 inserted into the mounting hole 58 of the magnet positioning member 56 is screwed into the screw hole 62 formed on the side wall 32*a* of the photoconductor case 5, which fixes the magnet positioning member 56 to the photoconductor case 5.

Through the above-described operations, the magnet positioning member 56 may be fitted into the first end 46*a* of the developing roller shaft 20 so that the developing roller shaft 20 cannot perform a practically relative rotation. Further, the magnet 10 is positioned with respect to the first positioning member 42*a* and is fixed to the photoconductor case 5, thereby having a proper circumference position. More specifically, when the magnet positioning member 56 is positioned with respect to the positioning member 42*a* positioning the developing roller 9 and the photoconductor 4, the developing roller shaft 20 is fitted into the magnet positioning member 56 to prevent the practically relative rotation, thereby properly fixing the circumference position of the magnet 10 and positioning the main pole of the magnet 10. When the practically relative rotation is prevented, the magnet positioning member 56 and the first end 46*a* of the developing roller shaft 20 may be fitted to each other without substantially wobbling in the circumferential direction.

The preceding discussion has assumed an image forming apparatus that includes one process cartridge, but the present invention is not limited only to such image forming. For example, an embodiment of the present invention can be an image forming apparatus using a plurality of process cartridges that are arranged in a horizontal plane and have respective toner colors, such as yellow, cyan, magenta, and black, to form respective color toner images. The respective toner color images can be transferred onto a recording medium directly or via an intermediate transfer member so that a full-color image may be obtained.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that within the scope of the appended claims, the invention may be practiced otherwise than as specifically described herein.

The invention claimed is:

1. A process cartridge, comprising:

an image bearing unit, comprising:

a photoconductor configured to form an image on a surface thereof; and a photoconductor case configured to accommodate the photoconductor;

a developing unit detachably combined with the image bearing unit, comprising:

a developer case configured to contain a developer; and a developing roller configured to carry the developer on a surface thereof to develop a toner image based on the image formed on the surface of the photoconductor, said developing roller having a magnet disposed therein;

first and second positioning members respectively attached to each side of the photoconductor case and the developer case when the photoconductor case and the developer case are attached in combination, and configured to position the developing roller and the photoconductor so as to regulate a gap formed between the developing roller and the photoconductor so as to have a predetermined distance; and a magnetic positioning member mounted externally of said first and second positioning members and positioned externally of said photoconductor case, said magnetic positioning member being engaged with a first axial end of the developing roller so as to prevent relative rotation with respect to the developer roller, positioned with respect to the first positioning member, and fixed to the photoconductor case.

2. The process cartridge according to claim 1, wherein:

the first positioning member comprises, a first developing roller positioning portion configured to position a first axial end of the developing roller; and a first photoconductor positioning portion configured to position a first axial end of the photoconductor, and the second positioning member comprises, a second developing roller positioning portion configured to position a second axial end of the developing roller; and a second photoconductor positioning portion configured to position a second axial end of the photoconductor.

3. The process cartridge according to claim 2, wherein:

the photoconductor case comprises side walls disposed opposite to each other at the photoconductor case and forming first and second holes thereon;

the first developing roller positioning portion of the first positioning member is a first developing roller positioning hole configured to engage with the first axial end of the developing roller extending from the developer case;

the first photoconductor positioning portion of the first positioning member is a first photoconductor positioning part configured to engage with the first hole of the photoconductor case;

the second developing roller positioning portion of the second positioning member has a positioning hole configured to engage with the second axial end of the developing roller extending from the developer case; and the second photoconductor positioning portion of the second positioning member is a second photoconductor positioning part configured to engage with the second hole of the photoconductor case.

4. The process cartridge according to claim 3, which comprises a photoconductor supporting shaft wherein:

the photoconductor is detachably held by said photoconductor supporting shaft mounted at an image forming apparatus;

the photoconductor supporting shaft is attached to the photoconductor by passing through the first and second axial ends of the photoconductor and the first and second holes of the photoconductor case when the process cartridge is mounted to the image forming apparatus; and the photoconductor supporting shaft is pulled out from the first and second axial ends of the photoconductor and the first and second holes of the photoconductor case when the process cartridge is removed from the image forming apparatus.

5. The process cartridge according to claim 4, wherein:

the photoconductor and the developing roller are positioned so that the gap formed between the photoconductor and the developing roller is regulated to the predetermined distance when the process cartridge is mounted to the image forming apparatus and the photoconductor supporting shaft is attached through the first and second axial ends of the photoconductor and the first and second holes of the photoconductor case.

6. The process cartridge according to claim 1, wherein:

the imaging bearing unit is positioned with respect to the developing unit by positioning the first and second axial ends of the developing roller and the first and second axial ends of the photoconductor to the first and second positioning members.

7. The process cartridge according to claim 1, wherein:

the developing unit further comprises:

a developing roller shaft configured to fixedly support the magnet and disposed to allow the developing roller to rotate.

8. A process cartridge, comprising:

a photoconductor case;

means for bearing an image positioned within said photoconductor case;

means for carrying a developer toward the means for bearing an image and having a magnet disposed therein; and first and second means for positioning the means for bearing an image and the means for carrying a developer so as to regulate a gap formed for image forming performed by the means for bearing an image and the means for carrying a developer to a predetermined distance; and a magnet positioning member mounted externally of said first and second means for positioning the means for bearing an image and the means for carrying a developer and positioned externally of said photoconductor case.

9. The process cartridge according to claim 8, wherein:

the first means for positioning positions the means for bearing an image and positions the means for carrying a developer together at one side of the means for bearing an image and the means for carrying a developer; and the second means for positioning positions the means for bearing an image and positions the means for carrying a developer together at a different side of the means for bearing an image and the means for carrying a developer, the different side being opposite to the one side thereof.

10. The process cartridge according to claim 8, wherein:

the means for bearing an image is positioned with respect to the means for carrying a developer by a predetermined positioning of the means for carrying a developer and the means for bearing an image with respect to the first and second means for positioning.

11. The process cartridge according to claim 10, wherein:

the means for bearing an image cooperates with means for supporting in which an image forming apparatus comprises;

the means for supporting is attached to the means for bearing an image by passing through the means for bearing an image when the process cartridge is mounted to the image forming apparatus; and the means for supporting is detached from the means for bearing an image when the process cartridge is removed from the image forming apparatus.

12. The process cartridge according to claim 11, wherein:

the means for bearing an image and the means for carrying a developer are positioned so that the gap formed between the means for bearing an image and the means for carrying a developer is regulated to the predetermined distance when the process cartridge is mounted to the image forming apparatus and the means for supporting is attached through the means for bearing an image.

13. The process cartridge according to claim 8, wherein:

the means for carrying a developer further comprises:

means for generating a magnetic field disposed inside the means for carrying a developer; and means for fixedly holding the means for generating a magnetic field and for allowing the means for carrying a developer to rotate, and the process cartridge further comprises means for engaging the means for carrying a developer so as to practically prevent relative rotation with respect to the means for carrying a developer, and positioned with respect to the first means for positioning.

14. A method of regulating a gap to a predetermined distance, comprising:

positioning a photoconductor and a developer roller with respect to first and second positioning members mounted on a photoconductor case;

positioning an image bearing unit and a developing unit by positioning the photoconductor and the developer roller; and mounting a magnetic positioning member externally of said first and second positioning members so as to be positioned externally of said photoconductor case, said magnetic positioning member engaging a first axial end of the developing roller so as to prevent relative rotation with respect to the developer roller, positioned with respect to the first positioning member, and fixed to the photoconductor case.

15. An image forming apparatus, comprising:

an optical writing unit configured to emit a laser light beam to write an image; and a process cartridge, comprising:

an image bearing unit, comprising:

a photoconductor configured to form the image emitted by the optical writing unit on a surface thereof; and a photoconductor case configured to accommodate the photoconductor;

a developing unit detachably combined with the image bearing unit, comprising:

a developer case configured to contain a developer; and a developing roller configured to carry the developer on a surface thereof to develop a toner image based on the image formed on the surface of the photoconductor, said developing roller having a magnet disposed therein; and first and second positioning members respectively disposed at each side of the photoconductor case and the developer case when the photoconductor case and the developer case are attached in combination, and configured to position the developing roller and the photoconductor so as to regulate a gap formed between the developing roller and the photoconductor to a predetermined distance; and a magnetic positioning member mounted externally of said first and second positioning members and positioned externally of said photoconductor case, said magnetic positioning member being engaged with a first axial end of the developing roller so as to prevent relative rotation with respect to the developing roller, positioned with respect to the first positioning member, and fixed to the photoconductor case.

* * * * *